US008327682B2

(12) United States Patent
Haase et al.

(10) Patent No.: US 8,327,682 B2
(45) Date of Patent: Dec. 11, 2012

(54) FENCE CLIP INSTALLATION TOOL

(75) Inventors: Reinhold A. Haase, Hastings, NE (US); Brandon William Miller, Juniata, NE (US)

(73) Assignee: Dutton-Lainson Company, Hastings, NE (US)

( * ) Notice: Subject to any disclaimer, the term of this patent is extended or adjusted under 35 U.S.C. 154(b) by 199 days.

(21) Appl. No.: 12/778,454

(22) Filed: May 12, 2010

(65) Prior Publication Data

US 2011/0277530 A1 Nov. 17, 2011

(51) Int. Cl.

| | |
|---|---|
| ***B21D 43/26*** | (2006.01) |
| *B25C 5/00* | (2006.01) |
| *B21F 1/00* | (2006.01) |
| *H01R 43/033* | (2006.01) |

(52) U.S. Cl. ..... 72/409.13; 72/409.04; 72/409.02; 140/106; 140/123

(58) Field of Classification Search ..... 72/409.02, 72/409.03, 409.04, 409.05, 409.13; 140/11, 140/49, 52, 56, 57, 102.5, 106, 117, 118, 140/123, 149

See application file for complete search history.

(56) References Cited

U.S. PATENT DOCUMENTS

| | | | | | |
|---|---|---|---|---|---|
| 751,352 | A | * | 2/1904 | Sehon | 81/300 |
| 838,008 | A | * | 12/1906 | Chandler et al. | 29/33.52 |
| 2,055,257 | A | * | 9/1936 | Maynard et al. | 72/409.02 |
| 2,955,624 | A | * | 10/1960 | Ferm | 140/123 |
| 3,067,748 | A | * | 12/1962 | Straith | 606/139 |
| 3,345,856 | A | * | 10/1967 | Werner et al. | 72/409.01 |
| 3,487,524 | A | * | 1/1970 | Filia | 29/750 |
| 4,090,390 | A | * | 5/1978 | Barinaga | 72/409.01 |
| 5,649,572 | A | * | 7/1997 | Lile | 140/57 |

* cited by examiner

*Primary Examiner* — Edward Tolan
*Assistant Examiner* — Lawrence J Averick
(74) *Attorney, Agent, or Firm* — Banner & Witcoff, Ltd.

(57) ABSTRACT

A fence clip installation tool includes a pair of handles pivotally joined to respective jaws pivotally maintained between two plates to enable the jaws to counter-rotate in unison. Clips of a compatible design may then be nested between the jaws and compressed or deformed about objects upon closure of the handles.

10 Claims, 6 Drawing Sheets

FENCE CLIP INSTALLATION TOOL

BACKGROUND OF THE INVENTION

In a principal aspect the present invention relates to a tool used to fasten items together, for example, to attach a strand of farm fence wire to a fence post by means of a metal clip.

Fencing may be attached to fence posts by fasteners such as staples, clips, ties, and the like. A common type of fence post is a steel T cross sectional shaped post which is designed to be driven into the soil or earth. Subsequently fencing wire, such as barbed wire, is attached to the T cross section fence post. Attachment may be effected in any of a number of ways. For example, metal ties may be utilized to attach the fence wire to the fence post. Another procedure is to clamp and form a U-shaped metal clip about the wire and post to thereby retain the fence wire tightly locked on to the post. The U-shaped metal clip may be crimped manually or by some tool to securely retain the fence wire attached to the steel fence post. When attaching a U-shaped metal clip to retain fence wire attached to a steel fence post, a worker may desire to use some type of tool that will provide a mechanical advantage necessary to bend and form the clip about the wire and post so that the clip will retain the fence wire on the post. The tool must be easy to manipulate and not overly bulky.

Additionally the clip must have a configuration which can be easily positioned and manipulated to fit around a length of fence wire as well as around at least a portion of the fence post to which the wire is to be attached. Further, the clip must be made of a material that maintains its configuration when it is formed about a fence post.

With these objectives, among others, in mind, the fence clip installation tool and associated clip of the present invention were developed.

SUMMARY OF THE INVENTION

Briefly, the present invention comprises a pliers type tool which includes a pair of manually actuated handles pivotally joined together at a generally intermediate pivot point. The inner end of each handle is also pivotally connected to an associated clip clamping jaw. The two jaws are also pivotally mounted to and between plates. The jaws also engage one another, for example, by engagement of meshed teeth, so that as a consequence the jaws will pivot with respect to each other in opposite rotational directions when actuated by the handles. Thus as the two handles are pivoted to a closed position about their pivotal connection, the jaws mounted between the plates will pivot toward one another and deform a clip retained between the jaws thereby enabling the clip to be fitted around and fasten a wire to a steel post.

The jaws thus counter-rotate as a result of their engaged gear teeth when they are pivoted about their respective pivot axis due to the movement of the handles of the tool. The jaws each include channels or depressions for engagement with the opposite ends of a U-shaped metal clip nested between the jaws and the plates. The plates, which are positioned on opposite sides of the pivoting jaws, serve to retain a clip in a position that enables the jaws to maintain a grip on the clip as the clip is formed or closed about items that are to be fastened together. The tool and associated clip may be used to fasten various items together in addition to wire and a steel post.

Thus it is an object of the invention to provide an improved fence clip installation tool.

It is a further object of the invention to provide a fence clip installation tool which is easily manipulated by manual operation.

Another object is to provide a tool which provides adequate mechanical advantage to deform a metal clip.

Another object of the invention is to provide a metal clip which in combination with an installation tool may be deformed and fastened about various objects.

Another object of the invention is to provide a metal clip that has a generally U-shaped configuration but is constructed so that it can be maintained in a clip installation tool during the installation operation using the tool.

Another object of the invention is to provide a clip installation tool into which a U-shaped metal clip may be easily inserted and retained in position during operation of the tool.

Yet another object of the invention is to provide a clip installation tool that enables clips to be retained and manipulated in a manner that ensures their ability to engage or attach two components such as fence wire and a fence post.

Another object of the invention is to provide a means for attaching fencing wire to steel fence posts that is less time consuming than by means of conventional wire ties.

Another object of the invention is to provide an inexpensive yet easily manipulated metal clip installation tool.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF EMBODIMENTS OF THE INVENTION

Figure 3:
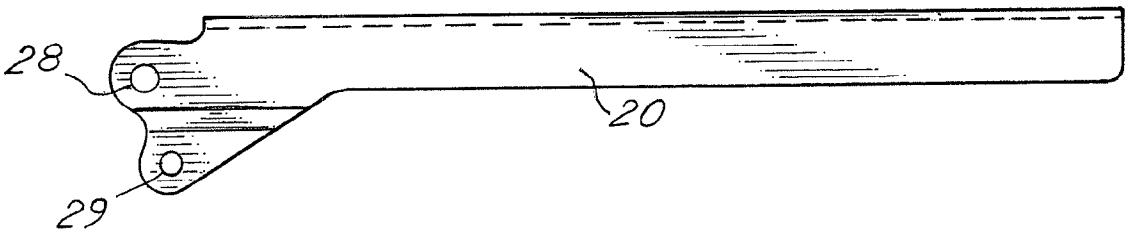
FIG. 3 is a top plan view of the handle of the installation tool.
Figure 4:
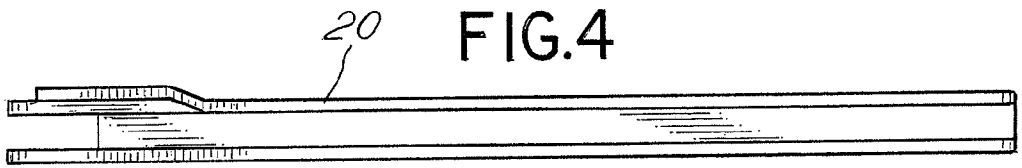
FIG. 4 is a side elevation of the handle of FIG. 3.
Figure 2B:
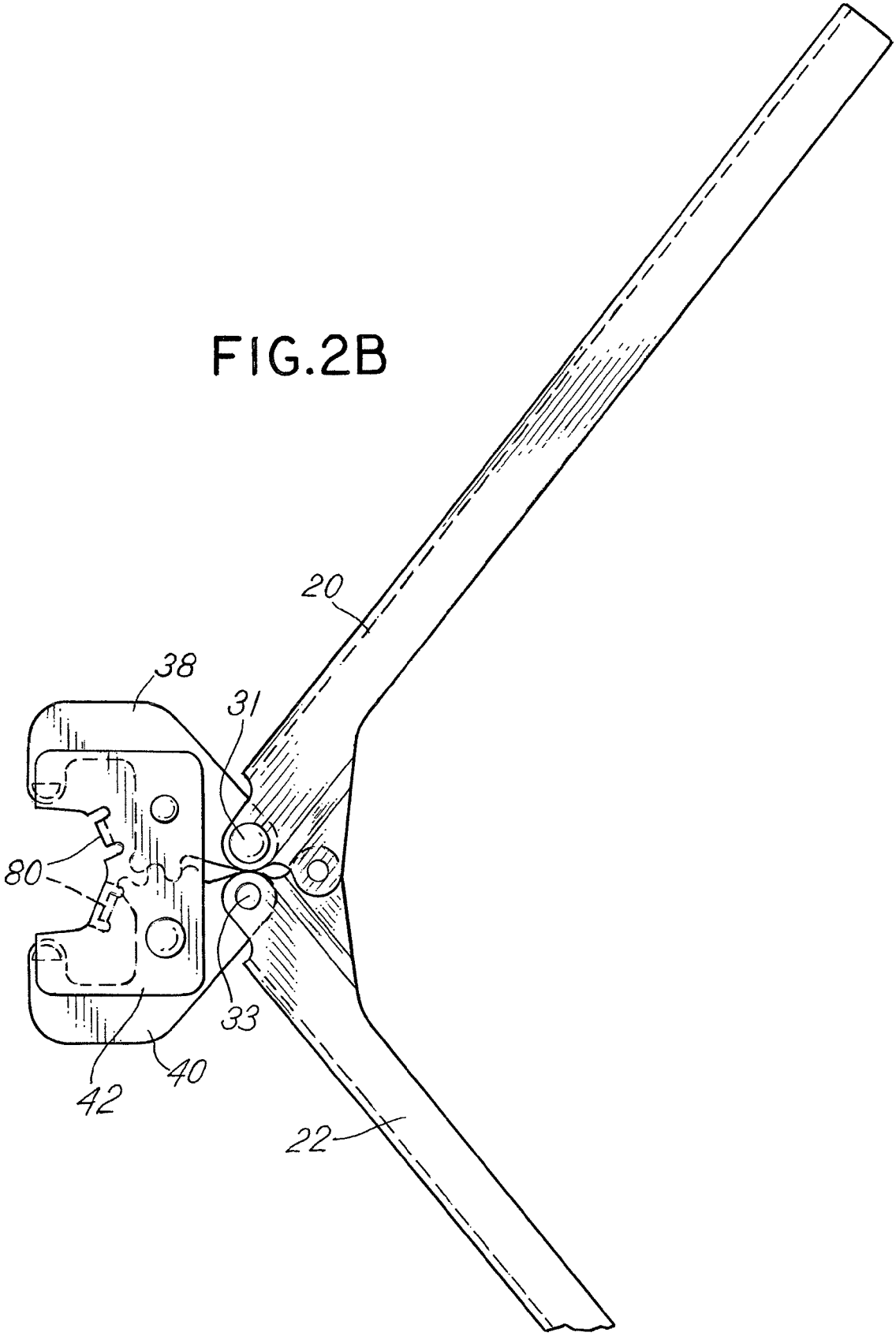
FIG. 2*b* is a plan view of the installation tool with the jaws in the open condition prior to placement of a clip between the jaws.
Figure 5:
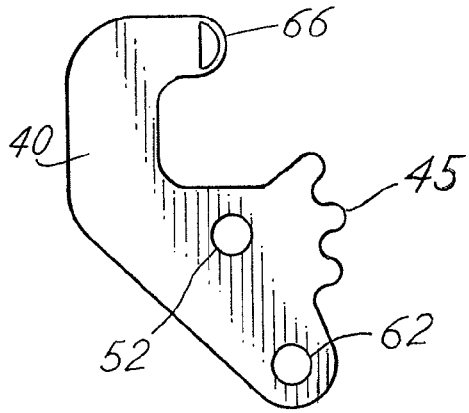
FIG. 5 is a plan view of a first jaw of the installation tool.
Figure 6:
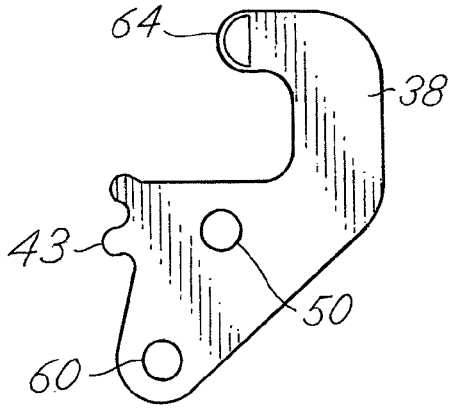
FIG. 6 is a plan view of a second jaw of the installation tool depicting the pivot openings therein and the engagement face for engaging a clip.

Referring to the Figures, an installation tool is comprised of a generally elongate, straight first handle 20 and a substantially identical second handle 22. The handles 20, 22 are typically formed from a sheet metal material. The handles 20, 22 each include an outer distal end or section 24 and 26 respectively. The handles 20, 22 also each include an inner end with pivot openings 28 and 30 respectively for receipt of jaw connection pivot pins 31 and 33 therethrough. The handles 20, 22 are pivotally joined together by a intermediate pivot connection 29. As can be seen by reference to FIGS. 3 and 4, the handles 20 and 22 are substantially identical though this aspect of the invention alone is not considered a limiting feature of the invention. That is the handles 20, 22 may have unique configurations provided they function in the manner of the embodiment described.

Typically the handles 20 and 22 are joined together at the pivot connection axis 32 by a bolt 35 and lock nut 36 which, in combination, enable adjustment of the tension on the pivotal connection 29 between the handles 20 and 22. That is, a certain amount of friction is desired with respect to the pivotal connection 32 to ensure that the tension or resistance to rotation upon movement of the handles 20, 22 relative to one another is adequate to preclude jaws 38, 40 (described below) and handles 20, 22 from moving due to gravity when the tool is being used. Thus a clip 100, as described hereinafter, will be held in the jaws 38, 40 and will remain nested therein and will not inadvertently fall or be released from the tool. The tension connection 32 also reduces risk of an accidental pinching injury due to unexpected movement of the tool components. The bolt 35 and lock nut 36 also allow tension adjustment by the tool owner, if needed, to compensate for tool wear.

As set forth above the tool includes the first jaw 38 cooperatively engaged with the second jaw 40. The tool also includes a first plate 42 and a second plate 44 substantially identical to the first plate 42. The first and second plates 42 and 44 are attached by pivot pins 46 and 48 respectively, extending through pivot openings 50 and 52 of first and second jaws 38 and 40. Thus the first jaw 38 includes a pivot opening 50 and the second jaw 40 includes a pivot opening 52. Pivot pins 46, 48 extend through the openings 39 and 41 in plates 42 and 44 which are placed respectively on opposite sides of the jaws 38 and 40 to enable the jaws 38, 40 to pivot with respect to one another. Jaw 38 includes gear teeth 43 that cooperate with gear teeth 45 of jaw 40 so that the jaws 38 and 40 will counter-rotate or pivot in unison uniformly in opposite rotational senses or directions about the respective axes of their respective pivot openings 50 and 52.

The jaws 38 and 40 further comprise, respectively, pivot pins 31, 33 providing respectively a pivotal connection through pivot openings 60 and 62 to the openings 28 and 30 associated of the respective handles 20, 22. Thus as the handles 20 and 22 are moved between a closed and open position by pivotal movement about the pivot connection axis 32, the jaws 38 and 40 will uniformly move or rotate about the respective axes of their axial openings 50 and 52 and pins 46, 48.

Each of the jaws 38 and 40 further includes a formed clip drive engagement face 64 and 66 which is formed by a cold forming operation and which comprises a groove 65 and 67 in the respective clip engagement face 64 and 66. Thus ends 101, 103 of clip 100 connected by coplanar crown 105 are nested between the jaws 38 and 40 and positioned to engage the channels or grooves 65 and 67 during the closure of the jaws 38, 40. The ends 101, 103 are retained in the grooves 65, 67 so that the clip 100 can be properly formed about items to be joined such as fence wire 102 to a post 104.

Figure 7:
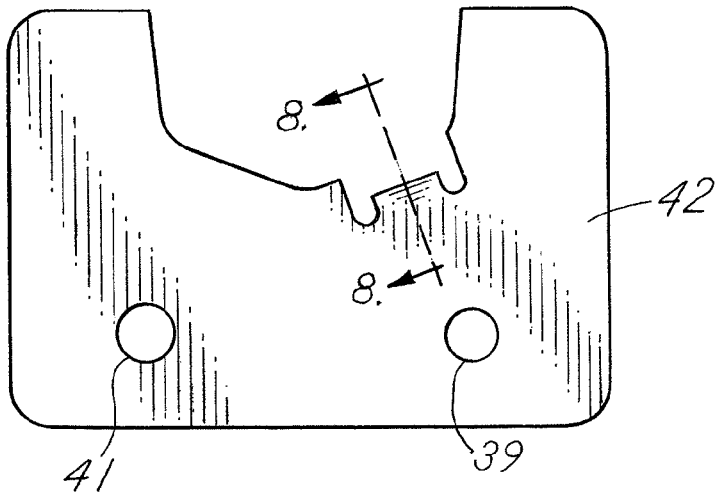
FIG. 7 is a plan view of a jaw connection plate.
Figure 8:
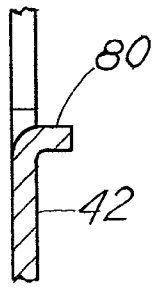
FIG. 8 is a cross section view of a retention tang or tab of the connection plate.

Referring to FIG. 7 there is depicted the generally rectangular, uniformly thick, plate 42 with pivot openings 39 and 41 that receive pivot pins 46, 48 for the jaws 38, 40. Two plates 42, 44 of the type depicted in FIGS. 7 and 8 are utilized. The two plates 42, 44 are positioned respectively on opposite sides of the jaws 38, 40. The jaws 38, 40 are formed from flat stock as are the plates 42 and 44 as depicted in FIG. 9.

Figure 1:
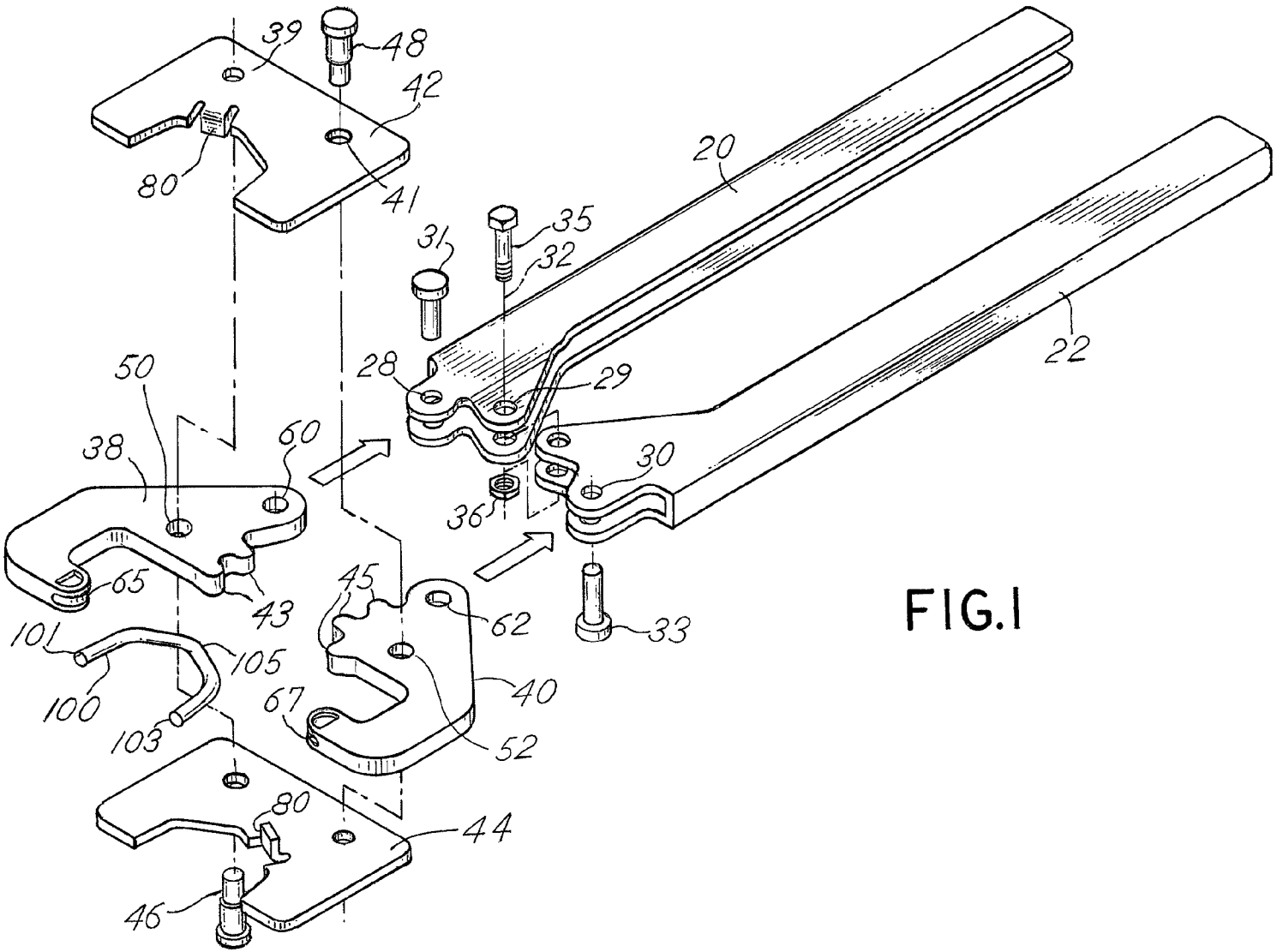
FIG. 1 is an exploded perspective view of the installation tool and an associated clip.
Figure 2A:
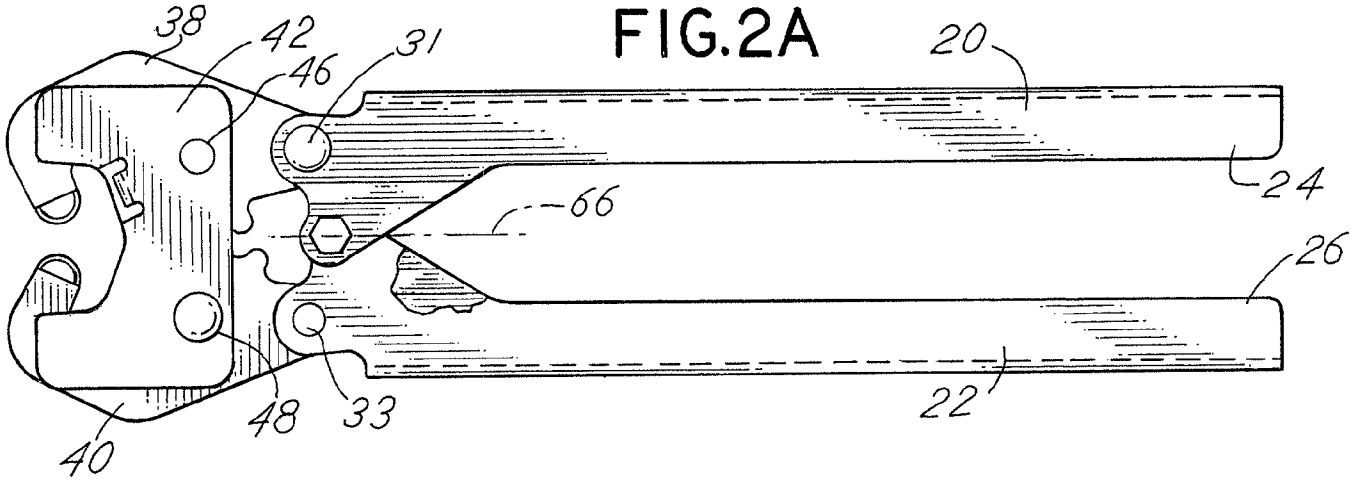
FIG. 2*a* is a plan view of the installation tool.
Figure 9:
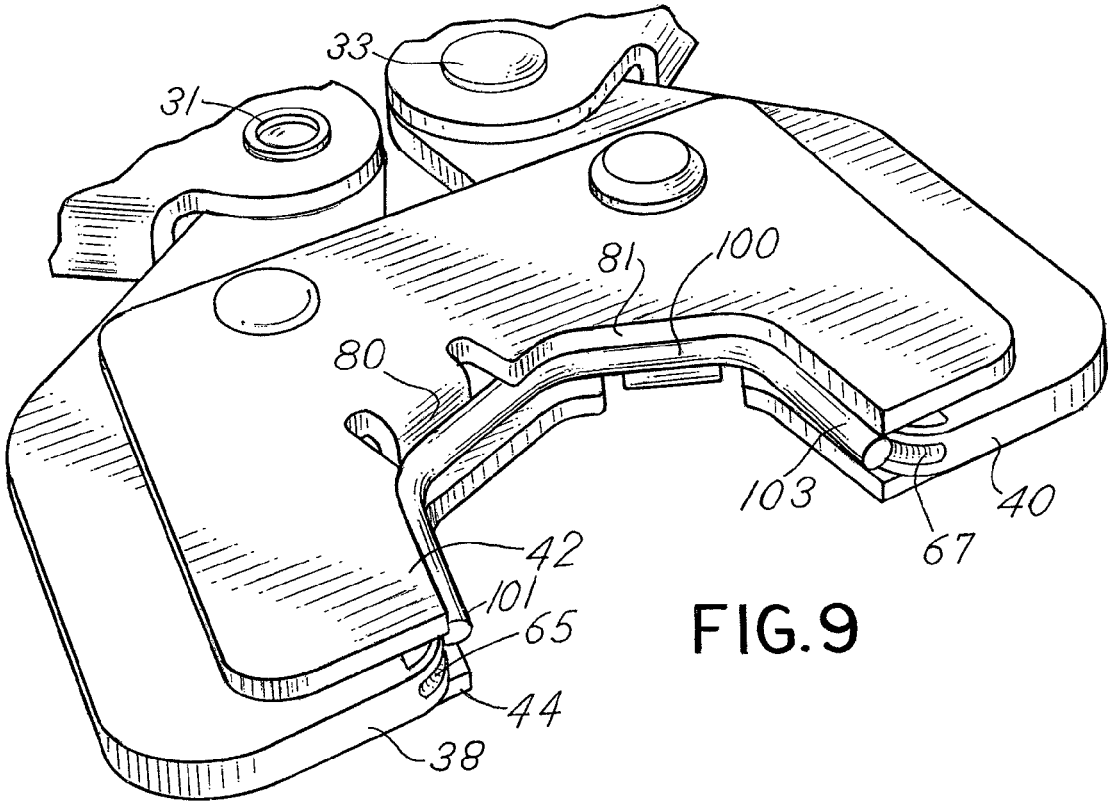
FIG. 9 is a perspective view of the open jaws of the assembled tool depicting the placement of a clip within the jaw connection plates maintained on opposite sides of the jaws which are pivotally mounted to the plates.

Referring to FIG. 9 the jaws 38 and 40 are positioned between plates 42 and 44 with the grooves 65, 67 of the jaws 38, 40 positioned to engage the ends 101, 103 of the clip 100 which is nested between the plates 42 and 44 for cooperation with the jaws 38, 40. The tool is thus designed to be symmetrically constructed about a longitudinal axis 66 in FIG. 2A.

Figure 10:
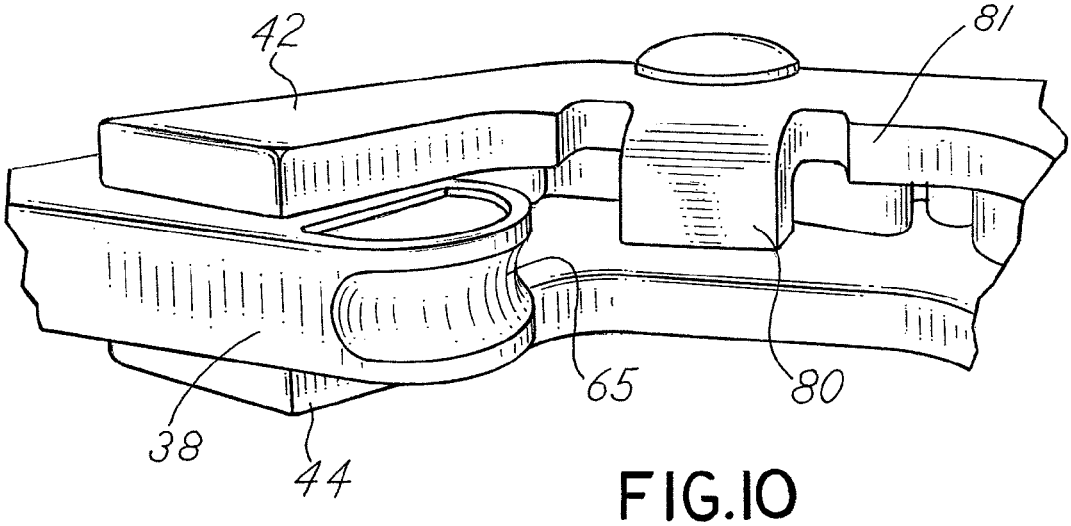
FIG. 10 is an enlarged perspective view of a jaw in combination with the jaw connection plates that retain the jaws pivotally connected thereto so that the jaws may pivot about their pivot axis in a coordinated manner.

The plates 42, 44 each include an arcuate cut out section and face 81 with a depending tang or tab 80 which engages against clip 100 to help retain clip 100 in place. FIG. 10 is a further view of plates 42 and 44 and the jaw 38 with groove 65 at the driving end thereof. The arcuate face 81 defines an opening or open space between jaws 38, 40 to enable access to the region between the jaws 38, 40. This opening enables manual access for the purpose of placement of clip 100 between the jaws 38, 40 and for fitting the formed arcuate opening in the plates 42, 44 and clip 100 about a wire and post.

Figure 11:
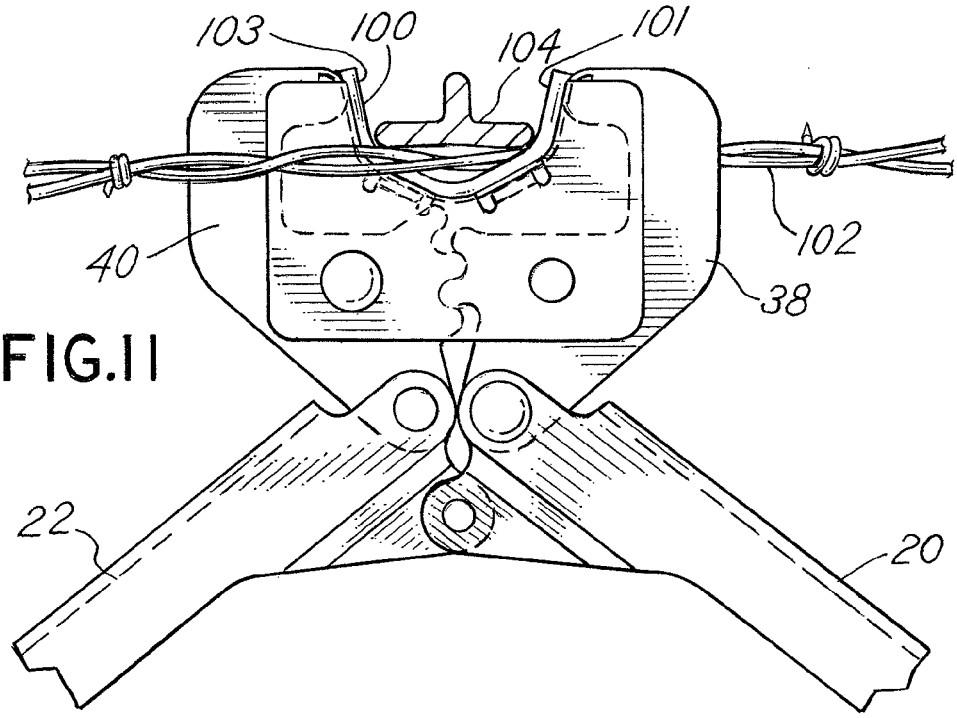
FIG. 11 is a perspective view illustrating the placement of a clip by means of the installation tool about a fence wire and a T shaped metal fence post.
Figure 12:
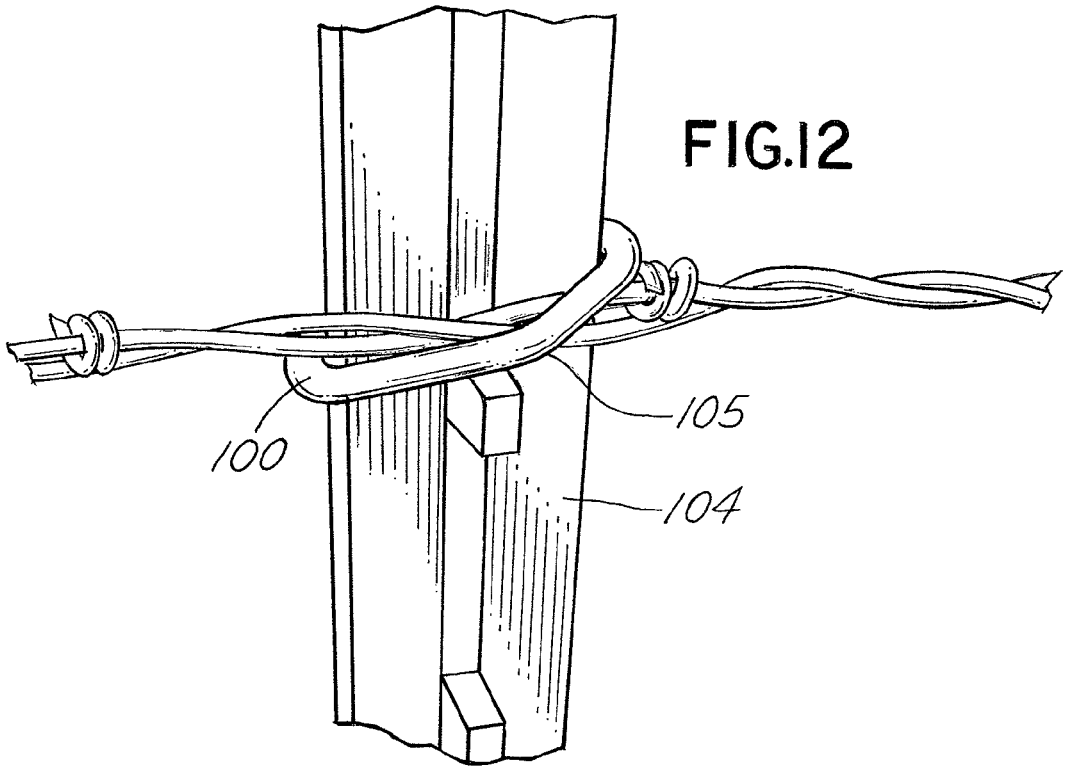
FIG. 12 depicts the placement of a deformed clip about the wire and fence post using the tool.

FIG. 11 depicts a clip loaded or positioned between the jaws 38, 40 and the manner in which the U clip loaded installation tool initially positions a clip 100 about fence wire 102 and a fence post 104. The handles 20 and 22 are then closed causing the jaws 38 and 40 to close thereby forming the clip 100 about the wire 102 and fence post 104 and assume the shape or configuration depicted, for example, in FIG. 12. The tool is designed symmetrically in order to apply a uniform force on each of the ends 101, 103 of the clip 100.

The various component parts comprising the tool are made or fabricated from flat metal sheet such as steel stock. The handles 20, 22 for example can be cut from flat stock and then formed into the configuration illustrated in FIGS. 3 and 4. The jaws 38, 40 are also formed or cut from flat stock. The plates 42 and 44 are also formed from flat stock.

In the embodiment disclosed, the pins or connecting rivets, e.g. pins or rivets 46, 48, are shoulder rivets. The shoulder on the pins or rivets 46, 48 enables maintenance of a fixed distance between the plates 42, 44 so that the jaws 38, 40 may rotate freely without binding or pinching by the plates 42, 44 during assembly or use of the tool.

The clip, such as the clip 100, has a generally planar U-shape and is configured prior to deformation by the tool in a manner which fits between the plates 42 and 44 so that the tab 80 associated with the plates 42, 44 may appropriately engage the backside of the clip 100 to hold it in position as the clip 100 is deformed by movement of the jaws 38, 40. The jaws 38, 40 in the open position have a spacing or configuration which is just slightly more than that of the spaced opposite side ends or arms 101 and 103 of the open clip 100. The clip 100 is maintained in position in the tool by slight closing of the handles 20, 22 resulting in a very slight closing of jaws 38, 40 creating a slight compression force between the jaws 38, 40 and the clip 100. The tangs or tabs 80 of plates 42, 44 further provide some force which maintains the clip 100 in position within or between the jaws 38, 40 of the tool. The tabs or tangs 80 project generally parallel to the pivot axes of the tool elements e.g. pins 31, 33. Thus the configuration and dimensions of the clip 100 may be customized to be cooperative with the configuration and spacing of the jaws 38, 40 and the configuration of the plates 42, 44. The described assembly provides a kit comprised of the installation tool as well as the fastener clips 100 which enable the placement of the clips 100 about fence wire 102 and a fence post 104 or any other pair of items about which clips 100 may be attached.

While there has been set forth a preferred embodiment of the invention it is to be understood that the invention is limited only by the following claims and equivalents thereof. For example different materials may be utilized in the practice of the invention including non-metallic materials. The configuration of the described clips may be altered provided that the compatibility of the clips and the installation tool are maintained. The interactivity or means for inner engaging the jaws may be effected by equivalent means or structures other than gear teeth. The dimensions and positions of the various pivot axes and pivot connections may be altered or amended to provide for additional mechanical advantage for example. Various other engineering alterations may be incorporated without departing from the spirit and scope of the present invention.

What is claimed is:

1. A fence clip installation tool comprising:

a first handle;

a second handle;

each handle including an outer end and an inner end, said handles pivotally connected at a connection axis intermediate the inner end and outer end thereof, a first clip engaging jaw;

a second clip engaging jaw;

each jaw including an outer end with a clip engagement face at said outer end, a pivot connection at an inner end, said inner end pivot connection of said first and second jaws pivotally joined respectively to the first and second handles at the inner ends thereof, said jaws each further including an intermediate pivot axis between the inner end and outer end of said jaws;

a clip retainer plate, said plate including first and second pivot connections joined respectively at the intermediate pivot axis of the first and second jaws, said first and second jaws each further including opposed, engaging meshed gear teeth elements engaged with each other, whereby the handles are capable of pivotal movement about the said handle connection axis toward one another to thereby effect rotational movement of said engaged meshed gear teeth elements of said first and second jaws and simultaneous counter-rotational movement of the jaws about their respective first and second pivot connections to the plate and consequent movement of said clip engagement faces of said jaws toward one another to effect closure of a U-shaped clip positioned between the clip engagement faces of said jaws, said plate including a clip retainer element to maintain a clip positioned in opposition to the clip engagement faces of the jaws, all of said axes being, generally parallel.

2. The tool of claim 1 wherein the plate clip retainer element comprises a tang member projecting from said plate intermediate the jaws and generally parallel to said pivot axes.

3. The tool of claim 1 including first and second retainer plates positioned respectively in opposite relation on opposite sides of said jaws.

4. The tool of claim 1 further including a clip retention groove in at least one of said jaw clip engagement faces.

5. The tool of claim 1 further including a clip retention groove in each said jaw clip engagement face.

6. The tool of claim 1 in combination with a U-shaped clip having first and second legs and a connecting crown, said legs and crown in a generally common plane, said legs spaced from each other a distance slightly less than the spacing of said clip retention faces when said jaws are positioned in a completely open position whereby said clip legs can be compressively engaged upon slight closing of said tool handles and jaws.

7. The tool of claim 6 further including a tang member projecting between said jaws from said plate, said tang generally parallel to said pivot axes and positioned to engage a clip having first and second legs engaging the engagement faces of the first and second jaws respectively.

8. The tool of claim 1 wherein said plate includes a generally arcuate face intermediate the jaws to facilitate placement of a clip between the jaws.

9. A fence clip installation tool comprising:

a first handle;

a second handle;

each handle including an outer end and an inner end, said handles pivotally connected at a connection axis intermediate the inner end and outer end thereof, a first clip engaging jaw;

a second clip engaging jaw;

each jaw including an outer end with a clip engagement face at said outer end, a pivot connection at an inner end, said inner end pivot connection of said first and second jaws pivotally joined respectively to the first and second handles at the inner ends thereof, said jaws each further including an intermediate pivot axis between the inner end and outer end of said jaws;

a first and a second clip retainer plate, each said plate including first and second pivot connections joined respectively at the intermediate pivot axis of the first and second jaws and positioned respectively on opposite sides of said jaws, said first and second jaws each further including opposed, engaging gear teeth elements engaged with each other, whereby the handles are capable of pivotal movement about the said handle connection axis toward one another to thereby effect rotational movement of said engaged gear teeth elements of said first and second jaws and simultaneous counter-rotational movement of the jaws about their respective first and second pivot connections to the plate and consequent movement of said clip engagement faces of said jaws toward one another to effect closure of a U-shaped clip positioned between the clip engagement faces of said jaws, at least one of said jaws including a clip retaining groove in its said jaw clip face, at least one of said retainer plates including a clip retainer element to maintain a clip positioned in opposition to the clip engagement faces of the jaws, all of said axes being generally parallel.

10. A fence clip installation tool comprising:

a first handle;

a second handle;

each handle including an outer end and an inner end, said handles pivotally connected at a connection axis intermediate the inner end and outer end thereof, a first clip engaging jaw;

a second clip engaging jaw;

each jaw including an outer end with a clip engagement face at said outer end, a pivot connection at an inner end, said inner end pivot connection of said first and second jaws pivotally joined respectively to the first and second handles at the inner ends thereof, said jaws each further including an intermediate pivot axis between the inner end and outer end of said jaws;

a clip retainer plate, said plate including first and second pivot connections joined respectively at the intermediate pivot axis of the first and second jaws, said first and second jaws each further including opposed, engaged meshed elements engaged with each other, whereby the handles are capable of pivotal movement about the said handle connection axis toward one another to thereby effect rotational movement of said engaged meshed elements of said first and second jaws and simultaneous counter-rotational movement of the jaws about their respective first and second pivot connections to the plate and consequent movement of said clip engagement faces of said jaws toward one another to effect closure of a U-shaped clip positioned between the clip engagement faces of said jaws, said plate including a clip retainer element to maintain a clip positioned in opposition to the clip engagement faces of the jaws, all of said axes being generally parallel.

* * * * *